United States Patent [19]

Rosendall

[11] Patent Number: 4,878,261

[45] Date of Patent: Nov. 7, 1989

[54] SWEEPER WITH PIVOTALLY MOUNTED DUST BIN

[75] Inventor: Henry J. Rosendall, Grand Rapids, Mich.

[73] Assignee: Bissell, Inc., Grand Rapids, Mich.

[21] Appl. No.: 228,259

[22] Filed: Aug. 4, 1988

[51] Int. Cl.[4] ..... A47L 11/08

[52] U.S. Cl. ..... 15/41 R

[58] Field of Search ..... 15/41 R–48 R, 15/49 C, 79 R, 79 A

[56] References Cited

U.S. PATENT DOCUMENTS

| | | | |
|---|---|---|---|
| 190,982 | 5/1877 | Prindle . | |
| 243,095 | 6/1881 | Wing . | |
| 248,379 | 10/1881 | Wing . | |
| 285,745 | 9/1883 | Gates . | |
| 329,374 | 10/1885 | Drew . | |
| 403,845 | 5/1889 | Kelley . | |
| 498,431 | 5/1893 | Hammett . | |
| 2,121,880 | 6/1938 | Miller | 15/48 |
| 2,185,753 | 1/1940 | Redfearn | 15/41 R |
| 2,319,631 | 5/1943 | Pullen | 15/41 R |
| 2,689,367 | 9/1954 | Parker . | |
| 3,092,862 | 6/1963 | Sherbondy . | |
| 3,629,892 | 12/1971 | Smyth et al. . | |
| 4,102,000 | 7/1978 | Liebscher et al. . | |
| 4,357,727 | 11/1982 | McDowell | 15/41 R |

*Primary Examiner*—Edward L. Roberts

*Attorney, Agent, or Firm*—Price, Heneveld, Cooper, DeWitt & Litton

[57] ABSTRACT

A floor sweeper for sweeping and collecting dirt and debris from a floor surface includes a rotative brush element and a cooperatively associated pivotal dust bin. The bin is pivotally mounted for movement between a generally horizontal operative position and a generally vertical dumping position. The bin further includes an opening along its forward wall which is adapted to receive the debris from the brush when the bin is in its operative position, and which is directed downwardly to release the debris when the bin is moved to its dumping position. To facilitate easy dumping and release of the debris contained within the bin, the housing is constructed with a stop face which permits the bin to be rocked about its vertical position and thereby knock against the housing to jar loose the debris contained therein and effect easy release thereof. To minimize the retention of the debris within the housing, the stop face is oriented such that the opening is continually directed downwardly through the entire rocking operation.

11 Claims, 3 Drawing Sheets

FIG. 1
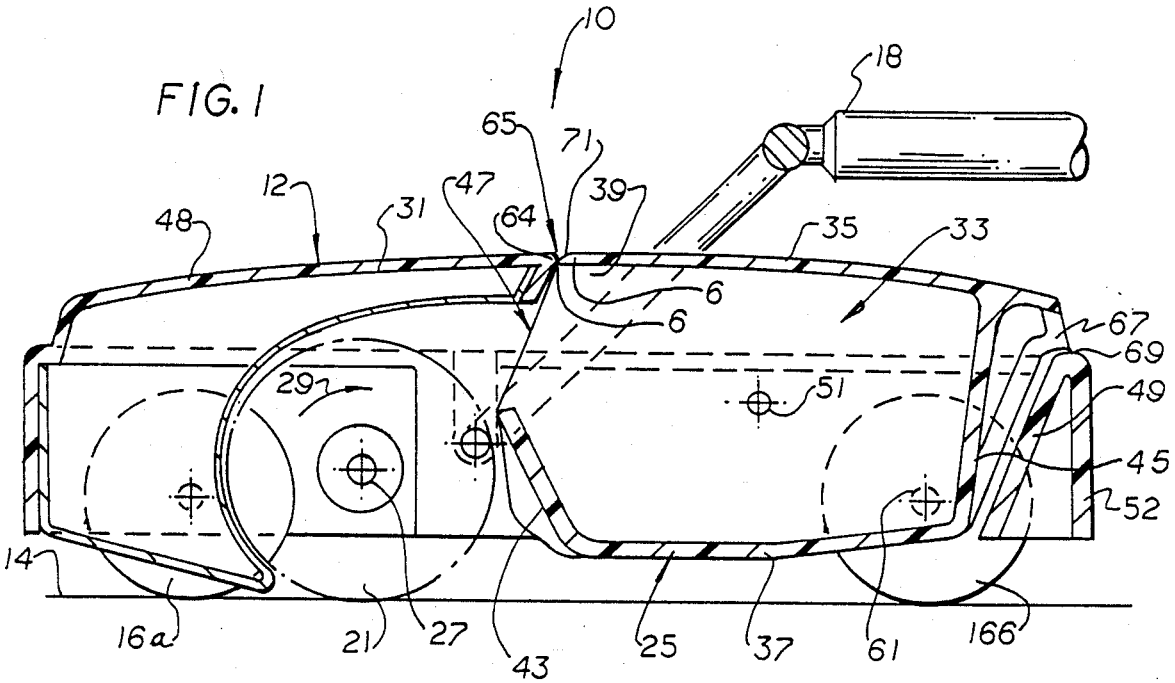
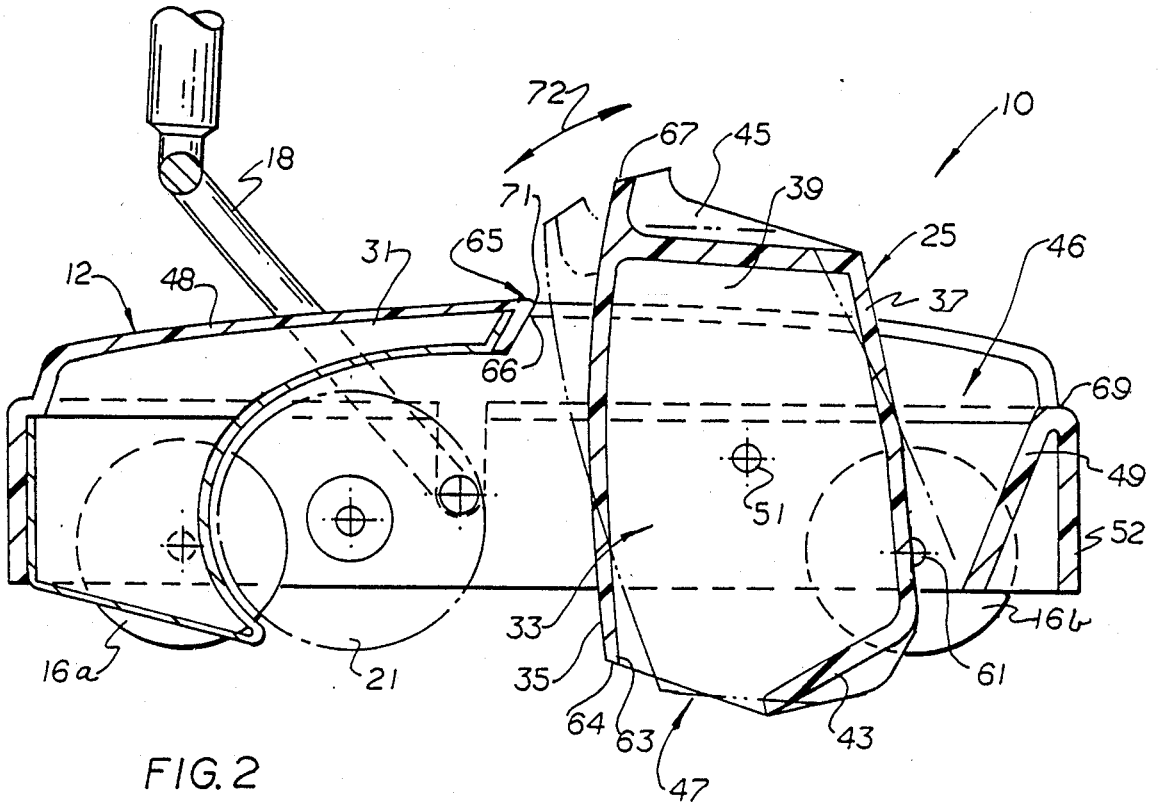
FIG. 2

SWEEPER WITH PIVOTALLY MOUNTED DUST BIN

BACKGROUND OF THE INVENTION

The present invention pertains to floor sweepers, and in particular to a sweeper having a unique dust bin construction. In floor sweepers, dust bins are positioned adjacent a rotative brush element to receive and collect the dirt and debris which is swept up by the brush. The emptying of the dust bin is generally accomplished by either removing the bin from the sweeper or pivoting the bin from its operative position to a dumping position.

The removal option facilitates easier dumping of the contents. The bin is knocked against the side of the trash receptacle or the like, to loosen and more easily dump the debris held therein. However, the removal and reattachment of the bins is a cumbersome activity requiring the user to typically bend over and latch or unlatch the bin from its housing. Furthermore, sudden jarring movements may be experienced in the removal of the bin, which may cause some of the debris to be spilled onto the floor and thereby create an additional cleaning task for the user.

In the pivoting dust bin arrangement, the bins are much more easily oriented to their dumping position. However, due to the nature of the debris collected and the amount of filling incurred between dumpings, the debris tends to become entwined and compacted into a mass which is not easily removed. In these situations, the user must resort to either attempting to rap the entire sweeper against the side of the trash receptacle, which is an unwieldy operation, or to slightly inverting the sweeper and digging out the debris with a finger or implement.

SUMMARY OF THE INVENTION

The aforementioned problems and deficiencies are overcome in the present invention, wherein a unique sweeper having a pivotally mounted dust bin is constructed and arranged to effect easy dumping of the dirt and debris collected therein. More specifically, the bin and the housing supporting the bin are cooperatively shaped and positioned such that the bin may be knocked against the housing in its dumping position to loosen and more easily empty the bin. By utilizing such an advantageous arrangement, the tasks of removing and reattaching the dust bin and manually digging the debris from the bin are alleviated.

These and other objects, advantages and features of the present invention will be more fully understood and appreciated by reference to the written specification and appended drawings.

BRIEF DESCRIPTION OF THE DRAWINGS

FIG. 1 is a cross-sectional view of the present invention taken along line I—I in FIG. 3;

FIG. 2 is the cross-sectional view of FIG. 1 with the dust bin pivoted to its dumping position;

DETAILED DESCRIPTION OF THE PREFERRED EMBODIMENT

Figure 3:
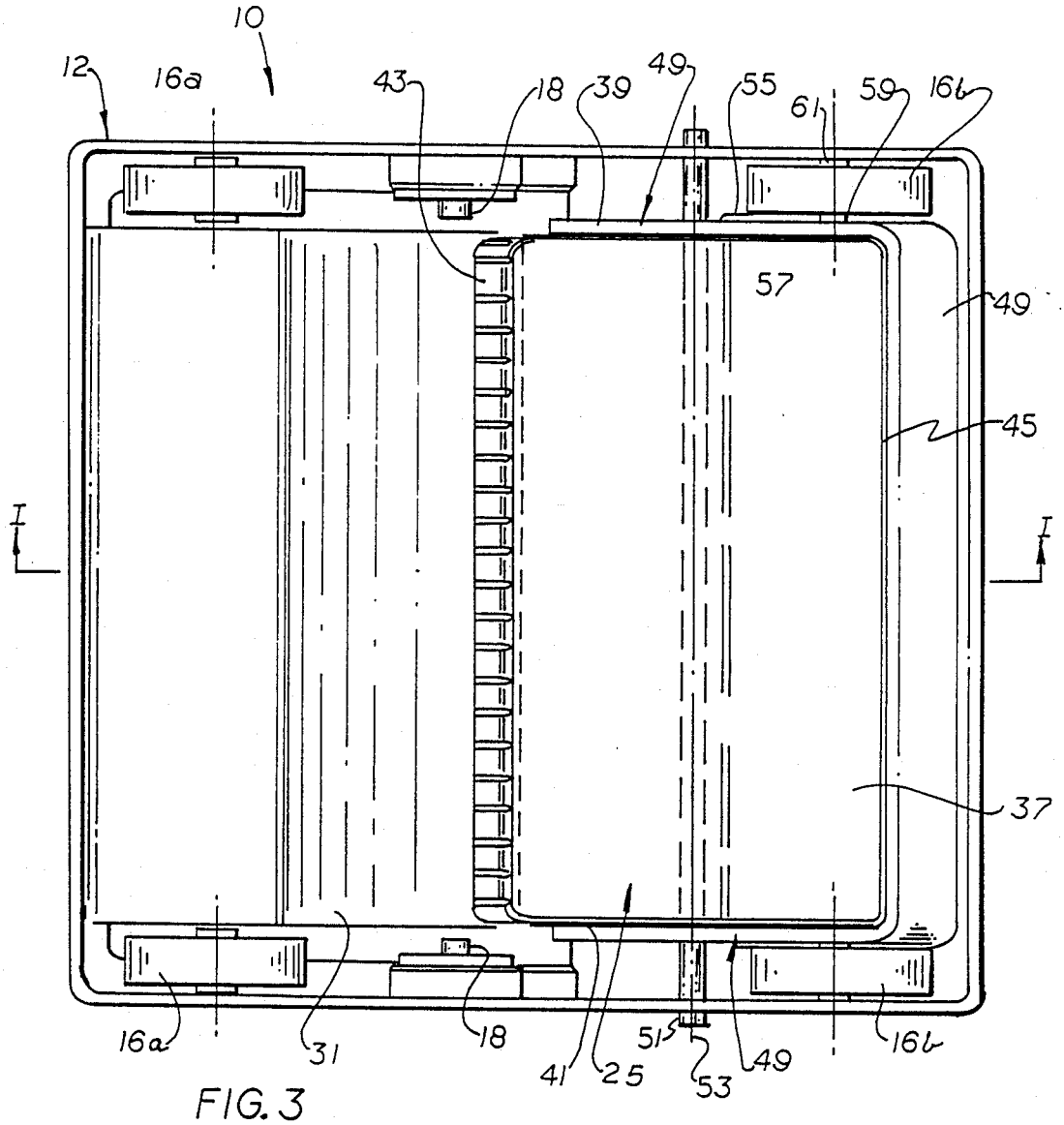
FIG. 3 is a bottom plan view of the present invention.
Figure 4:
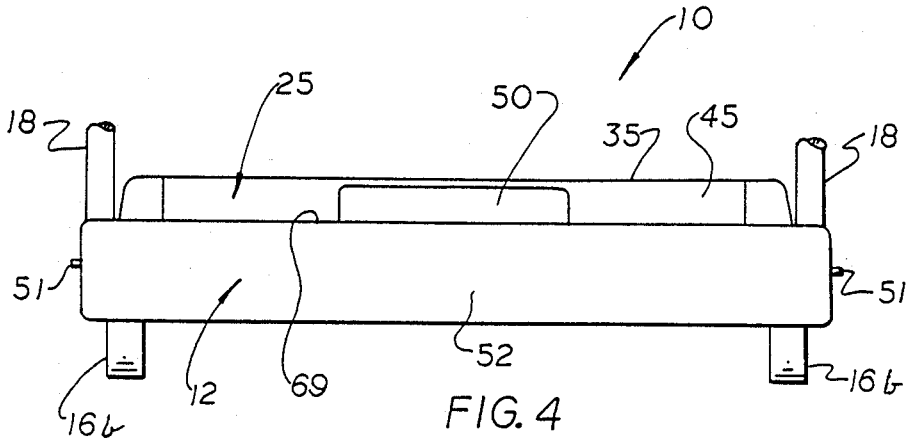
FIG. 4 is a rear elevational view thereof.
Figure 5:
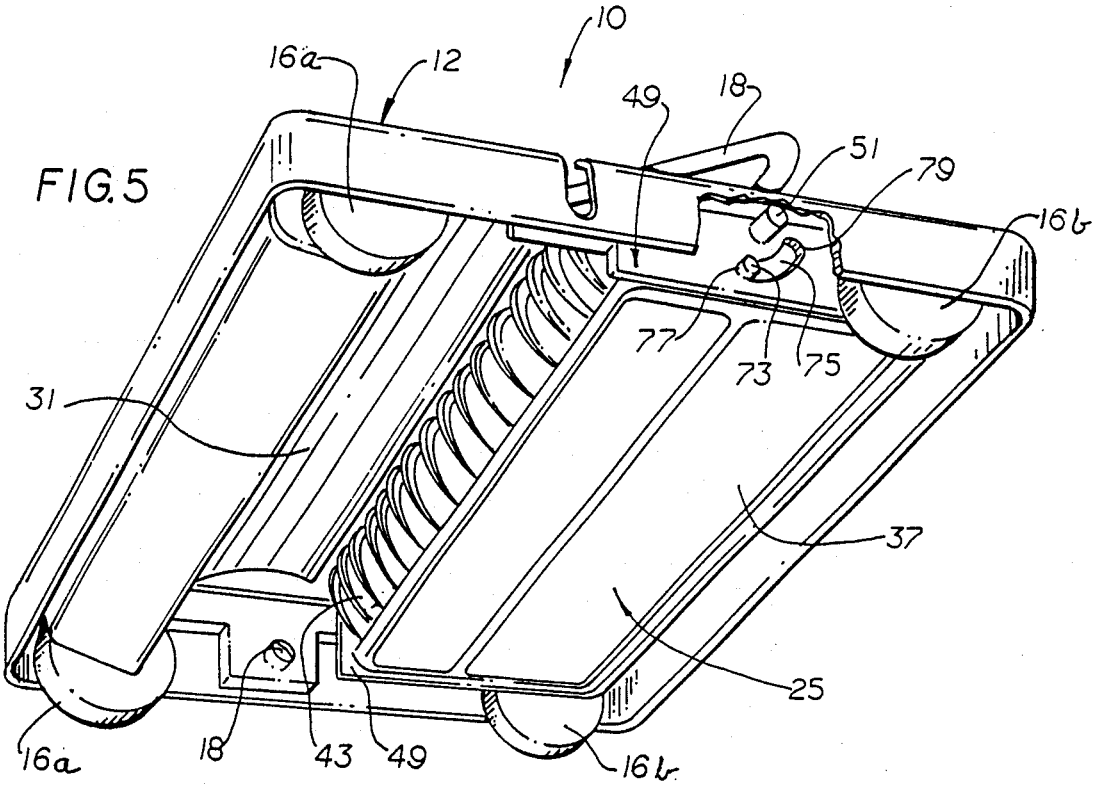
FIG. 5 is a perspective view of a second embodiment of the present invention partially broken away.
Figure 6:
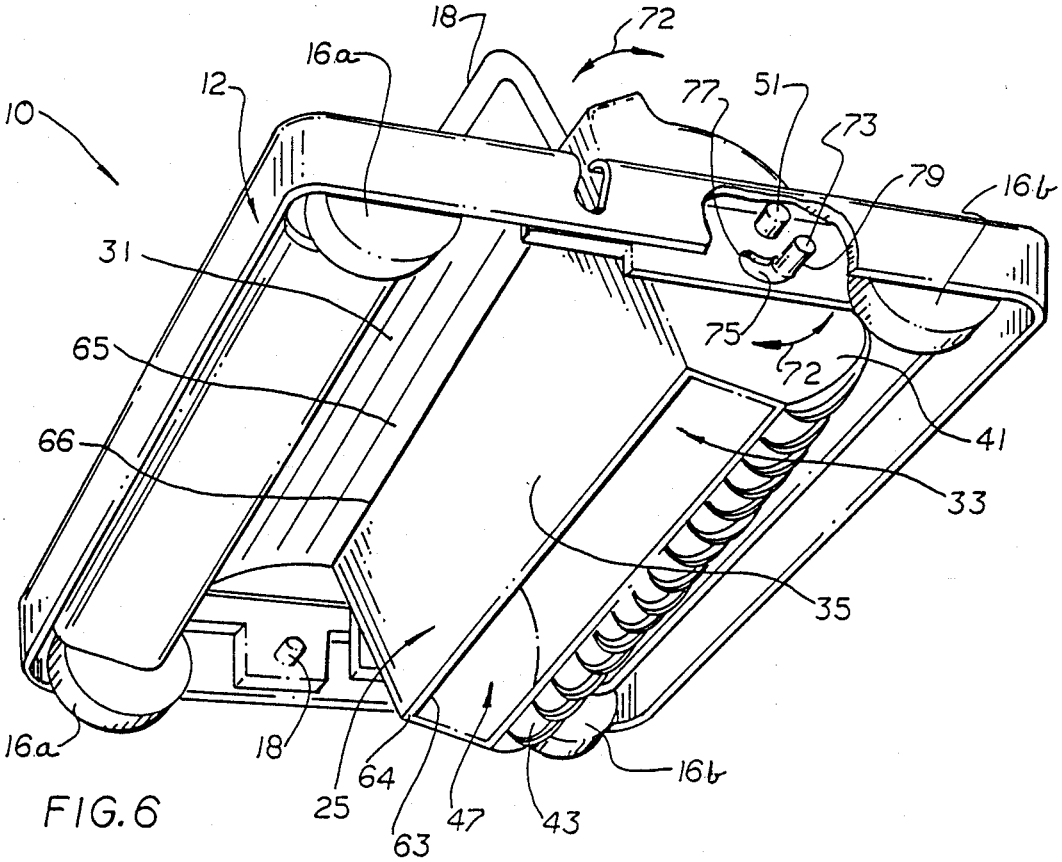
FIG. 6 is the perspective view of FIG. 4 with the dust bin pivoted to its dumping position.

In the preferred embodiment, floor sweeper 10 includes a housing 12 supported on a floor surface 14 by a plurality of wheels 16. A pivotal handle 18 is operably connected to housing 12 to facilitate manual movement and control of the sweeper 10. Within housing 12 a rotating brush 21 and a pivotally secured dust bin 25 are provided to sweep and collect dirt and debris from floor 14.

Rotating brush 21 is preferably mounted upon axle 27 for rotation within housing 12. Brush 21 is driven in any conventional manner, such as by drive rollers (not shown) which are fixedly attached to the ends of brush 21 and engage the forward rollers 16a for actuation therewith. In this construction, then, as sweeper 10 is pushed across the floor, brush 21 rotates clockwise (as seen in FIGS. 1 and 2) in a direction indicated by arrow 29, to engage the debris and lift it from floor 14 with its bristles (not shown). To accomplish the collection of such debris thereby lifted, brush 21 is mounted adjacent an arcuate shield 31 which maintains the debris on the bristles and works to guide it along an arcuate rearwardly directed path. This cooperative action of rotating brush 231 and arcuate shield 31 directs the debris to be thrown into the adjacent dust bin 25.

Dust bin 25 is a generally large, hollow container having an inner cavity 33 defined by top and bottom walls 35, 37, opposite sidewalls 39, 41 and front and rear walls 43, 45. Front wall 43 including an opening 47 through which the debris is thrown by brush 21 for collection purposes. More particularly, opening 47 is of an elongated transverse shape which extends the entire length of brush 21 and is positioned adjacent the end of shield 31 to ensure that no significant amount of debris is lost back onto floor surface 14 during operation of sweeper 10. In contrast to most floor sweepers which utilize open dust pans to collect the swept debris, bin 25 completely encloses cavity 33 with the sole exception of opening 47 through which the debris is received therein. This construction ensures that the debris is received entirely within bin 25 for easy disposal thereof, and does not collect and become caked onto the inner surfaces of the housing 12 positioned above and about bin 25.

Bin 25 is pivotally mounted within a generally U-shaped mounting flange 49 which overlies sidewalls 39, 41 and rear wall 45. Pivot pin 51 passes through aligned apertures in sidewalls 39, 41 and flange 49 to thereby pivotally mount bin 25 about a horizontal, transverse axis 53. This arrangement enables bin 25 to be swung between its operative position wherein opening 47 is oriented to receive dirt and debris from brush 21 (FIG. 1), and its dumping position wherein opening 47 is oriented downwardly for emptying cavity 33 of the debris so collected (FIG. 2).

Preferably, bin 25 is received and oriented within a cavity or opening 46 in housing 12 such that top wall 35 defines a segment of the top of sweeper 10. More specifically, the top of sweeper 10 is defined by an upper wall 48 of housing 12 and top wall 35 of bin 25, which are positioned to form a substantially continuous surface when bin 25 is in its operative position (FIG. 1). This arrangement economizes the needed space for bin 25 and thereby serves to reduce the overall size of sweeper 10.

To facilitate the manual pivoting action of bin 25, rear wall 45 includes a handle 50. Preferably, handle 50 is defined by a recess located directly beneath top wall 35 of bin 25 and above back wall 52 of housing 12 so that it opens rearwardly for easy receipt of the user's hand. Of course, the handle could have a variety of other constructions. Further, pivot pin 51 is positioned relative to bin 25, so that handle 50 is always positioned above housing 12 for easy grasping and manipulating thereof.

In operation, dust bin 25 is adjustably held in its operative position (FIG. 3) by a torsion spring 55; although, numerous other biasing means could be utilized. Torsion spring 55 includes opposite ends 57, 59 which are positioned to engage and cooperatively interact with sidewall 39 and axle 61 (mounting one rear wheel 16b) (FIG. 3), respectively, to bias bin 25 in a clockwise direction about pin 51 (as seen in FIGS. 1 and 2). To accommodate the rotative movements of bin 25, mounting flange 49 includes an arcuate opening (not shown) through which end 57 of spring 55, engaging bin 25, may travel.

Bin 25 is positioned in its operative orientation and held against further clockwise rotation (as seen in FIGS. 1 and 2) by a plurality of corresponding abutting faces 64, 66, 67, 69 on bin 25 and housing 12. More specifically, bin 25 includes a forwardly extending ledge 63 having an upper surface 64 which is adapted to abuttingly engage abutment face 66 integrally molded to housing 12. In like manner, rear wall 45 of bin 25 includes a rearwardly projecting abutment flange 67 which overlies and engages upper edge 69 of back wall 52 arranged along the rear of housing 12. These cooperatively abutting faces 64, 66 and 67, 69 act to stop the rotation of bin 25 under the force of torsion spring 55, and accurately position opening 47 to receive the debris from brush 21 as discussed above.

Once dust bin 25 has become substantially filled with the debris swept from floor surface 14, sweeper 10 may be carried to and positioned over a suitable trash receptacle (not shown). At this point, bin 25 is manually rotated from its operative position, in a counterclockwise direction (as seen in FIGS. 1 and 2) about pin 51, against the bias of spring 55, until opening 47 is directed substantially downwardly (FIG. 2). In this position, the debris may, if able, slide through opening 47 into the awaiting trash receptacle. However, as is often the case, the debris becomes clogged in cavity 33 and opening 47 and thus fouls the dumping operation.

Sweeper 10, however, is cooperatively constructed to permit bin 25 to be knocked against a dust knocker stop 65 on housing 12 to thereby provide a series of jolting impacts which function to loosen and dislodge the debris stuck in bin 25 and effect easy emptying thereof. More particularly, as best seen FIG. 2, dust knocker stop 65 defines a stop face 71 oriented to face forwardly toward bin 25. In this arrangement, top wall 35 of bin 25, when rotated counterclockwise (as seen in FIGS. 1 and 2) about pin 51 to its dumping position (FIG. 2), may be easily knocked against dust knocker stop in a rocking motion illustrated by arrow 72.

Stop face 71 is specifically positioned to be near top wall 35 when bin 25 is moved to a vertical orientation with opening 47 directed downwardly. With this construction, bin 25 is rocked preferably through a range of approximately twenty degrees to each side of the vertical position (although other ranges could be utilized), so that bin 25 may be repeatedly knocked against dust knocker stop 65 until all of the debris contained therein has been released. By so positioning stop face 71, opening 47 is continually directed downwardly during the impacting of the dumping operation to minimize the retaining forces applied to the debris by the sides of bin 25, and thereby enhance the release thereof. After the debris has been so removed, spring 55 will act to return bin 25 to its operative position (FIG. 1).

In an alternative embodiment, the knocking of bin 25 may be achieved by a shaft 73 projecting outwardly from sidewall 41 of bin 25 (of course, a corresponding shaft may also project from sidewall 39). More particularly, shaft 73 is received through an arcuate slot 75 provided in an adjacent segment of mounting flange 49. As bin 25 rotates about pivot pin 51, shaft 73 moves along the length of slot 75. In its operative position, shaft 73 preferably engages one end 77 of slot 75 to (additionally or in place of abutting faces 64, 66, 67, 69) hold bin 25 in its proper operative position. In its dumping position, bin 25 may be rocked, in the same manner as discussed above in regard to the first embodiment, such that shaft 73 is knocked against opposite end 79 of slot 75 which acts as the dust knocker stop to thereby create the jolting impacts which dislodge the debris from bin 25.

Of course, it is understood that the above is merely a preferred embodiment of the invention, and that various other embodiments as well as many changes and alterations may be made without departing from the spirit and broader aspects of the invention.

The embodiments of the invention in which an exclusive property or privilege is claimed are defined as follows.

1. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said dust bin and said dust knocker stop being oriented such that said dust bin opening be directed substantially downwardly throughout the knocking of said dust bin against said dust knocker stop;

said dust bin further being oriented in a substantially vertical orientation in said dumping position, wherein said dust bin is rocked only slightly from said vertical orientation when knocking said dust bin against said dust knocker stop, so that retention of the debris by walls defining said bin and said opening is minimized; and said dust bin further being swung within a range of substantially twenty degrees to each side of a true vertical position when rocking said dust bin to knock against said dust knocker stop.

2. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said dust bin and said dust knocker stop being oriented such that said dust bin opening is directed substantially downwardly throughout the knocking of said dust bin against said dust knocker stop;

said dust bin further being oriented in a substantially vertical orientation in said dumping position, wherein said dust bin is rocked only slightly from said vertical orientation when knocking said dust bin against said dust knocker stop, so that retention of the debris by walls defining said bin and said opening is minimized; and said dust knocker stop further including a generally vertical stop face, and in which said dust bin further includes a top wall, wherein said top wall strikes said stop face to cause said knocking of said dust bin.

3. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said dust bin and said dust knocker stop being oriented such that said dust bin opening is directed substantially downwardly throughout the knocking of said dust bin against said dust knocker stop;

said dust bin further being oriented in a substantially vertical orientation in said dumping position, wherein said dust bin is rocked only slightly from said vertical orientation when knocking said dust bin against said dust knocker stop, so that retention of the debris by walls defining said bin and said opening is minimized; and said dust bin further including a projecting shaft and said housing further including a slot through which said shaft travels as said dust bin moves between said operative position and said dumping position, wherein said slot includes a pair of opposite ends, and wherein said shaft strikes said dust knocker stop defined by one of said ends of said slot to cause said knocking of said dust bin.

4. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein; and said dust knocker stop further including a generally vertical stop face, and in which said dust bin further includes a top wall, wherein said top wall strikes said stop face to cause said knocking of said dust bin.

5. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein; and said dust bin further including a projecting shaft and said housing further including a slot through which said shaft travels as said dust bin moves between said operative position and said dumping position, wherein said slot includes a pair of opposite ends, and wherein said shaft strikes said dust knocker stop defined by one of said ends of said slot to cause said knocking of said dust bin.

6. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said floor sweeper further including a spring means acting between said housing and said dust bin for normally biasing said dust bin in said operative position;

said housing including a first abutment surface and said dust bin including a second abutment surface, wherein said first and second abutment surfaces abuttingly engage one another to accurately position said opening of said dust bin to receive the debris from said brush when said bin is in said operative position; and said housing further including a top and bottom, and a cavity extending through said top and bottom of said housing, and in which said dust bin further includes a top wall, wherein said dust bin is received within said housing cavity such that said top wall of said dust bin is substantially aligned with said top of said housing when said dust bin is in said operative position to thereby form a top surface of said sweeper.

7. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein; and said housing further including a top and bottom, and a cavity extending through said top and bottom of said housing, and in which said dust bin further includes a top wall, wherein said dust bin is substantially aligned with said top of said housing when said dust bin is in said operative position to thereby form a top surface of said sweeper.

8. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative positive wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said housing further including a top and bottom, and a cavity extending through said top and bottom of said housing, and in which said dust bin further includes a top wall, wherein said dust bin is substantially aligned with said top of said housing when said dust bin is in said operative position to thereby form a top surface of said sweeper; and said top of said housing mounts said dust knocker stop, wherein said top wall strikes said dust knocker stop to cause said knocking of said dust bin.

9. A floor sweeper comprising:

a housing;

a plurality of wheels rollingly supporting said housing on a floor surface;

a brush element rotatively mounted in said housing for sweeping debris from the floor surface;

a dust bin for receiving and collecting the debris swept up by said brush element, said dust bin including an opening through which the debris is passed into and out of said dust bin, said dust bin being pivotally mounted to said housing for movement between an operative position wherein said opening is positioned to receive within said dust bin the debris from said brush, and a dumping position wherein said opening is positioned downwardly to effect release of the debris contained therein;

a dust knocker stop fixed to said housing and oriented such that said dust bin can be rocked to repeatedly knock against said dust knocker stop when said dust bin is in said dumping position to dislodge any debris retained therein;

said housing further including a top and bottom, and a cavity extending through said top and bottom of said housing, and in which said dust bin further includes a top wall, wherein said dust bin is substantially aligned with said top of said housing when said dust bin is in said operative position to whereby form a top surface of said sweeper;

said dust bin further including a handle positioned above said housing to facilitate manual pivoting of said dust bin between said operative position and said dumping position.

10. A method for emptying debris from a dust bin of a floor sweeper, comprising:

providing a floor sweeper having a housing, a dust knocker stop fixed to said housing, a brush rotatably mounted to said housing for sweeping debris from a floor surface, and a dust bin pivotally mounted to said housing adjacent said brush, said dust bin further including an opening;

moving said floor sweeper across a floor surface such that said brush sweeps debris from the floor and deposits it through said opening and into said dust bin;

transporting the floor sweeper to a dumping location;

manually pivoting said dust bin such that said opening is directed generally downwardly;

rocking said dust bin so that it knocks against said dust knocker stop to loosen and dislodge the debris until the debris has been released from said dust bin; and said provided dust knocker stop further including a stop face and said provided dust bin further including a top wall, and wherein said knocking of said dust bin includes striking said top wall against said stop face.

11. A method for emptying debris from a dust bin of a floor sweeper, comprising:

providing a floor sweeper having a housing, a dust knocker stop fixed to said housing, a brush rotatably mounted to said housing for sweeping debris from a floor surface, and a dust bin pivotally mounted to said housing adjacent said brush, said dust bin further including an opening;

moving said floor sweeper across a floor surface such that said brush sweeps debris from the floor and deposits it through said opening and into said dust bin;

transporting the floor sweeper to a dumping location;

manually pivoting said dust bin such that said opening is directed generally downwardly;

rocking said dust bin so that it knocks against said dust knocker stop to loosen and dislodge the debris until the debris has been released from said dust bin; and said provided housing further including an arcuate slot having a pair of opposite ends and said provided dust bin further including a shaft which extends through said slot, and wherein said knocking of said dust bin includes striking said shaft against said dust knocker stop defined by one of said ends of said slot.

* * * * *

UNITED STATES PATENT AND TRADEMARK OFFICE

CERTIFICATE OF CORRECTION

PATENT NO. : 4,878,261

DATED : November 7, 1989

INVENTOR(S) : Henry J. Rosendall

It is certified that error appears in the above-identified patent and that said Letters Patent is hereby corrected as shown below:

Column 2, Line 26:

"231" should be --21--

Column 3, Line 57:

"forwardly" should be --rearwardly--

Column 4, Claim 1, Line 57:

"be" should be --is--

Column 8, Claim 8, Line 11:

"positive" should be --position--

Column 8, Claim 9, Line 59:

"whereby" should be --thereby--

Signed and Sealed this

Sixteenth Day of April, 1991

*Attest:*

*Attesting Officer*

HARRY F. MANBECK, JR.

*Commissioner of Patents and Trademarks*